US006463243B1

(12) United States Patent
Boogert et al.

(10) Patent No.: US 6,463,243 B1
(45) Date of Patent: Oct. 8, 2002

(54) REFILL MECHANISM FOR TONER POWDER

(75) Inventors: Edwin Alexander Boogert, Baarlo; Hubertus Henricus Tiggelers, Venlo, both of (NL)

(73) Assignee: Oce Technologies B.V., Venlo (NL)

( * ) Notice: Subject to any disclaimer, the term of this patent is extended or adjusted under 35 U.S.C. 154(b) by 0 days.

(21) Appl. No.: 09/910,728

(22) Filed: Jul. 24, 2001

(30) Foreign Application Priority Data

Jul. 24, 2000 (EP) ..... 00202625

(51) Int. Cl.[7] ..... G03G 15/08
(52) U.S. Cl. ..... 399/258; 141/364; 399/106
(58) Field of Search ..... 399/258, 262, 399/103, 106, 120; 222/DIG. 1, 325, 505; 141/311 R, 284, 346, 363, 364

(56) References Cited

U.S. PATENT DOCUMENTS

| | | | | |
|---|---|---|---|---|
| 4,491,161 A | * | 1/1985 | Tamura et al. | 141/364 |
| 4,834,246 A | | 5/1989 | Inoue et al. | 229/122.2 |
| 5,091,750 A | * | 2/1992 | Yoshida et al. | 399/106 |
| 5,520,229 A | * | 5/1996 | Yamada | 141/364 |
| 5,729,794 A | | 3/1998 | Schwallie et al. | 399/106 |

FOREIGN PATENT DOCUMENTS

| | | | |
|---|---|---|---|
| JP | 04-066983 | * | 3/1992 |
| JP | 06-067534 | * | 3/1994 |

OTHER PUBLICATIONS

Patent Abstracts Japan, vol. 016, No. 394 (p. 1406) &JP04128855 (April 30, 1992).

* cited by examiner

*Primary Examiner*—Sophia S. Chen
(74) *Attorney, Agent, or Firm*—Birch, Stewart, Kolasch & Birch, LLP

(57) ABSTRACT

A refill mechanism for filling toner powder from a refill container into a toner reservoir of a copier or printer, which includes a refill opening formed in the top of the toner reservoir; a drawer slideable between an open position and a closed position for opening and closing the refill opening; a spout formed on the refill container and closed by a slide; and a mounting structure for mounting the spout on the toner reservoir in a position above the refill opening, such that the slide is engaged in a recess of the drawer and, when the drawer is moved into the open position, the slide is moved together with the drawer for opening the spout, so that the toner powder drops into the toner reservoir, wherein the top surface of the slide is covered by a foil which projects over the trailing edge of the slide, as viewed in the direction of the opening movement, and overlaps the adjacent edge of the recess of the drawer.

8 Claims, 8 Drawing Sheets

REFILL MECHANISM FOR TONER POWDER

BACKGROUND OF THE INVENTION

The present invention relates to a refill mechanism for filling toner powder from a refill container into a toner reservoir of a copier or printer, which includes

- a refill opening formed in the top of the toner reservoir;
- a drawer slideable between an open position and a closed position for opening and closing the refill opening;
- a spout formed on the refill container and closed by a slide; and
- a mounting structure for mounting the spout on the toner reservoir in a position above the refill opening, such that the slide is engaged in a recess of the drawer and, when the drawer is moved into an open position, is moved together with the drawer for opening the spout, so that the toner powder drops into the toner reservoir.

A copier, a printer or any other device which develops an image with toner powder utilizes a toner reservoir which accommodates a supply of fine toner powder which is gradually consumed in the course of image development. From time to time, the toner reservoir needs to be refilled with toner powder from a refill container, e.g. a bottle, a refill cartridge or the like. Since the toner powder typically consists of very fine toner particles, even a slight air draft is sufficient for swirling up a dust of toner particles, when the toner powder is exposed to the open air. Since the toner is strongly pigmented, this dust is likely to stain the environment. For this reason, it is necessary that the refill mechanism is designed to prevent the toner powder from being exposed to the open air even during the refill process, so that no toner dust will be generated and the user who refills the toner reservoir is protected against direct contact exposure to the toner powder.

When the drawer is opened, the lower surface of the spout wipes over the top surface of the drawer, and the toner powder is swept into the refill opening. It turns out, however, that in the course of frequent refill processes occurring during the lifetime of the copier, a certain amount of toner powder may accumulate on the top surface of the drawer. As a result, slight amounts of toner powder may escape into the environment and may stain the fingers and clothes of the user. More importantly, when the drawer and the slide which are both in sliding contact with the lower surface of the spout are moved back and forth between open and closed positions, toner powder may be entrained into the gap between the sliding surfaces and, due to frictional heat, will be sintered or baked together to form coating layers on the sliding surfaces. These coating layers are eventually peeled-off, so that flakes of sintered toner material are likely to drop into the toner reservoir and disturb the developing process, whereby the quality of the developed images is impaired.

In order to reduce this effect, resilient sealing pads may be employed which are relatively tightly pressed against the sliding surfaces of the slide and the drawer so as to prevent the toner powder from being deposited on these surfaces. This, however, leads to an increased frictional resistance and may make it difficult to manually operate the drawer and the slide.

SUMMARY OF THE INVENTION

It is accordingly an object of the present invention to provide a refill mechanism which is easy to operate and nevertheless avoids the formation of toner flakes which may drop into the toner reservoir.

According to the present invention, this object is achieved by the feature that the top surface of the slide is covered by a foil which projects over the trailing edge of the slide, as view ed in the direction of the opening movement, and overlaps with the adjacent edge of the recess of the drawer.

Since the slide and the drawer are both in sliding engagement with the lower surface of the spout and the slide is further engaged in the recess of the drawer, there exists not only a horizontal gap between the lower surface of the spout and the top surfaces of the slide and the drawer, but also a vertical gap between the slide and the wall of the recess at the trailing edge of the slide. In the prior art arrangement, the vertical gap upwardly opens into the horizontal gap, so that a T-shaped gap configuration is obtained. When the drawer is opened, the open vertical gap moves across the open cross-section of the spout and becomes filled with toner powder. Even when a resilient sealing pad is provided at the lower surface of the spout surrounding the opening cross section, so as to wipe off the toner powder from the top surfaces of the slide and the drawer, the toner powder accumulated in the vertical gap cannot be removed. This toner powder is therefore entrained into a region where the horizontal gap exists between the slide and the drawer on the one hand and the sealing pad of the spout on the other hand. Here, the toner powder is supported by the walls of the vertical gap which move relative to the sealing pad, and friction between the toner powder and the sealing paid will cause the toner powder to enter into the horizontal gap and to form sintered flakes.

The present invention is based on the observation that this effect is the main reason for the occurrence of toner flakes. Therefore, according to the present invention, the vertical gap is covered by the projecting part of the foil, so that no toner powder may enter into the vertical gap.

Since the projecting part of the foil overlaps the adjacent edge of the drawer, a minor step is formed between the top surface of the foil and the top surface of the drawer adjacent thereto. When the drawer is opened, the sealing pad of the spout rides over this step, and the toner powder can successfully be wiped off from the surface of the foil and the surface of the drawer in the descending direction of the step. As a result, only minor remnants of toner powder will remain right in front of the step. When the drawer is closed again, the step formed by the foil prevents these remnants of toner from coming into frictional contact with the sealing pad of the spout. Since an increased pressing force exists between the sealing pad and the edge of the foil which forms the step, the toner powder is efficiently prevented from entering into the gap between the top surface of the foil and the sealing pad. In addition, if toner powder adheres to the lower surface of the sealing pad, this toner powder will be scraped off by the edge of the foil which forms the leading edge when the drawer is closed. As a result, the entry of toner powder into the horizontal gap and the formation of toner flakes are successfully prevented.

BRIEF DESCRIPTION OF THE DRAWINGS

More specific features of the PRESENT invention and their advantages will become evident from the description of a preferred embodiment of the present invention given hereinbelow in conjunction with the drawings, in which.

DETAILED DESCRIPTION OF THE INVENTION

Figure 1:
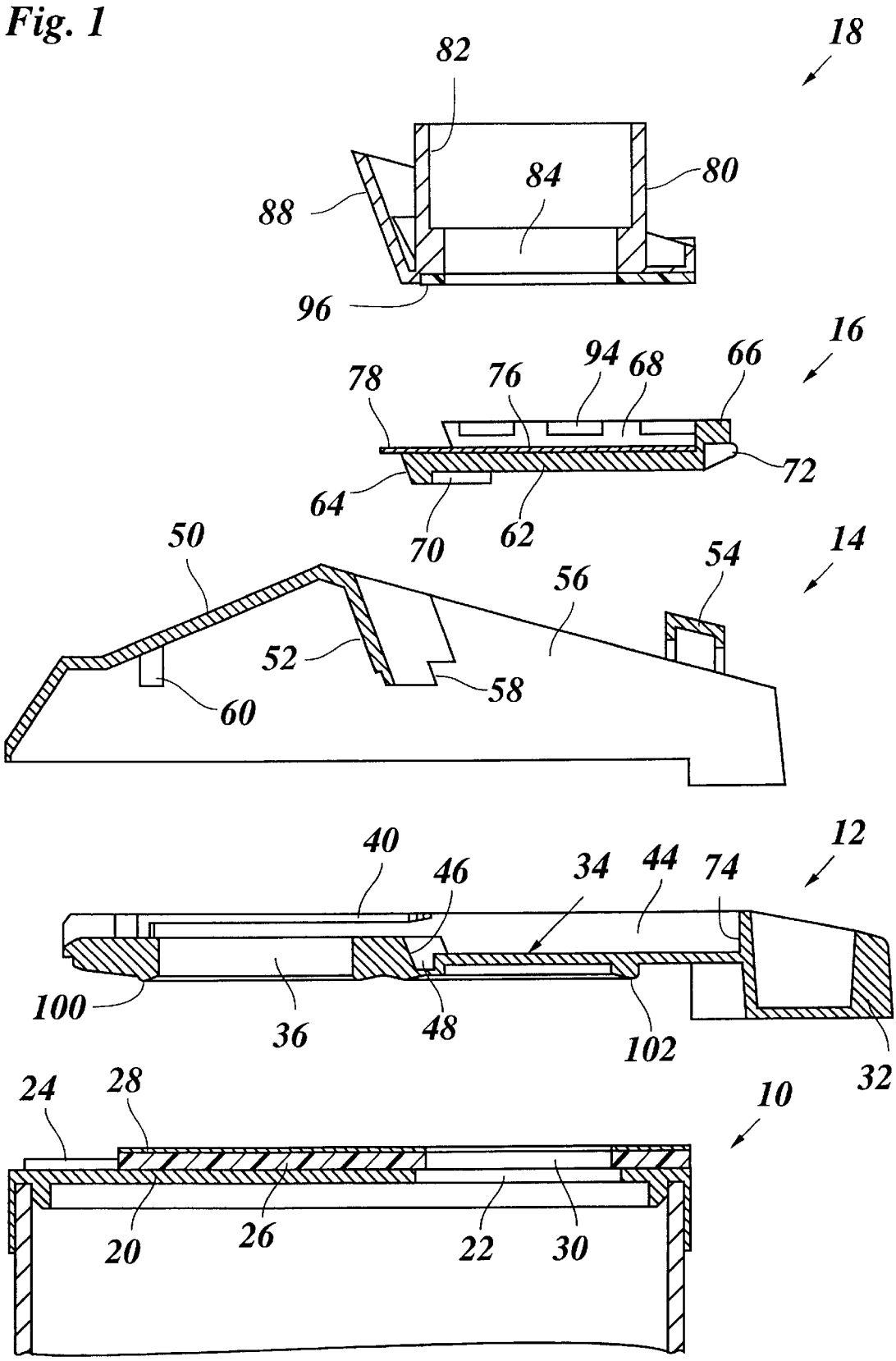
FIG. 1 is an exploded longitudinal section of the component parts of the refill mechanism according to the present invention.

FIG. 1 shows, from the bottom to the top, an upper part of a toner reservoir 10 of, for example, a copier, a drawer 12 slidably disposed on top of the toner reservoir 10, a mounting structure 14, a slide 16 and a spout 18 of a refill container.

Figure 2:
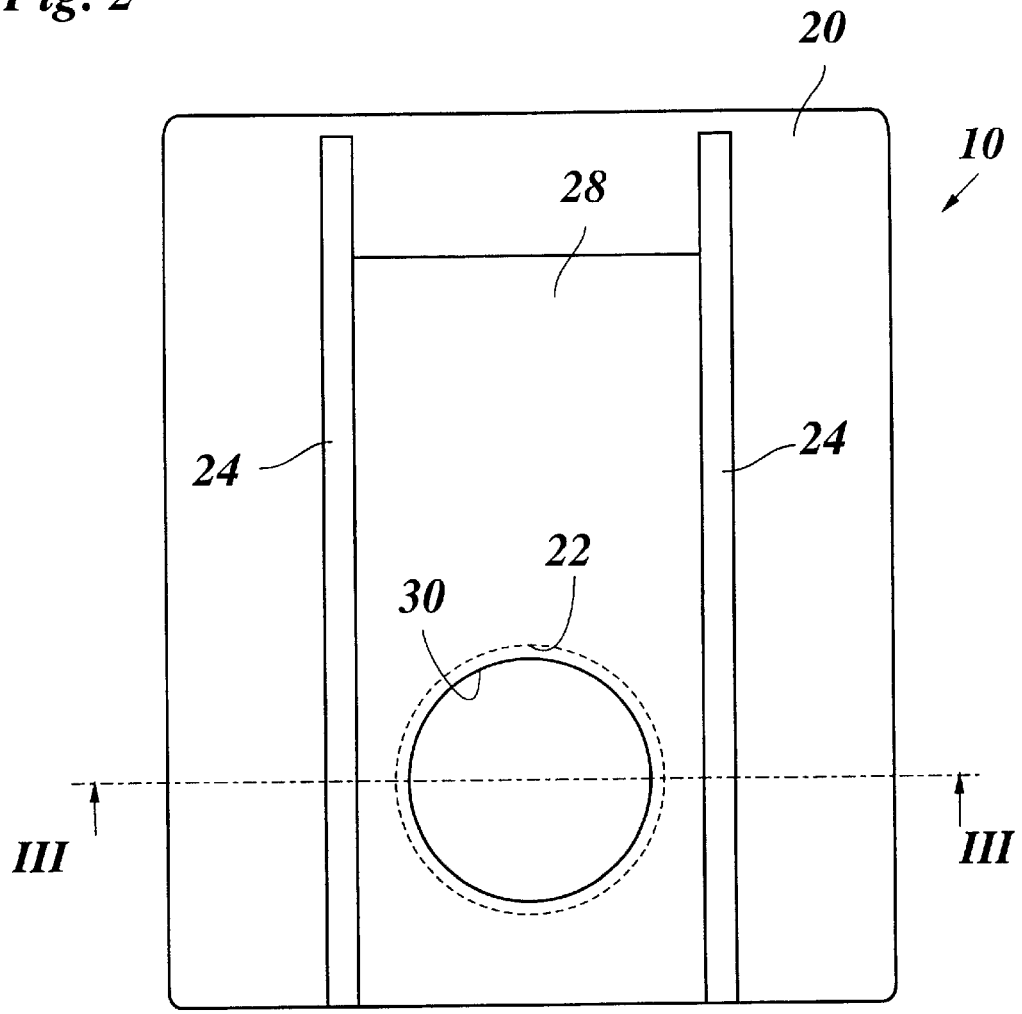
FIG. 2 is top plan view of the toner reservoir.
Figure 3:
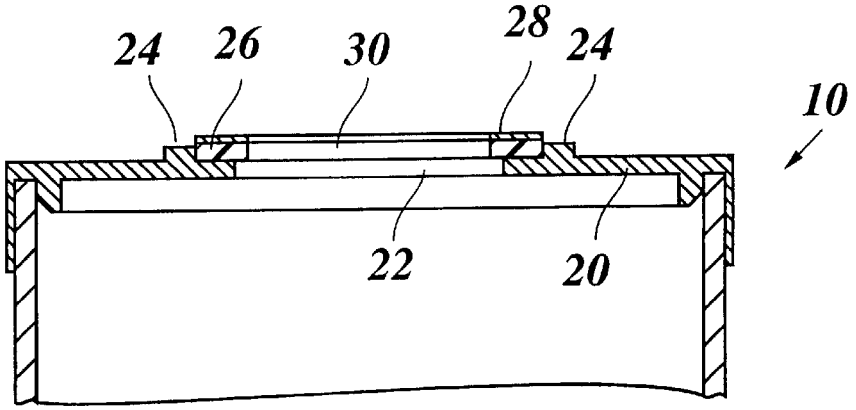
FIG. 3 is a cross-section taken along the line III—III of FIG. 2.

As is shown in FIGS. 1, 2 and 3, the toner reservoir 10 is tightly closed at the top end by a wall 20 which forms a circular refill opening 22 through which toner powder may drop into the interior of the toner reservoir. The top surface of the wall 20 has two parallel ribs 24 formed symmetrically on both sides of the refill opening 22. A cushion 26 of elastomeric material is secured on the top surface of the wall 20 and fills the space between the two ribs 24. The cushion 26 is covered by a plastic film 28 which provides the cushion with a smooth surface finish. The surface of the film 28 is slightly elevated in comparison to the ribs 24. The cushion 26 and the film 28.are formed with a through-hole 30 which is concentric with the refill opening 22 but has a slightly smaller diameter.

The drawer 12 has a handle 32 and a plate 34 which is slidingly supported on the flat top surface of the film 28. The plate 34 has a through-hole 36 which, in the position shown in FIG. 1, is offset from the refill opening 22, so that the refill opening is closed by the plate 34. When the drawer 12 is drawn-out to the right side in FIG. 1, the through-hole 36 may be made to coincide with the refill opening 22.

Figure 4:
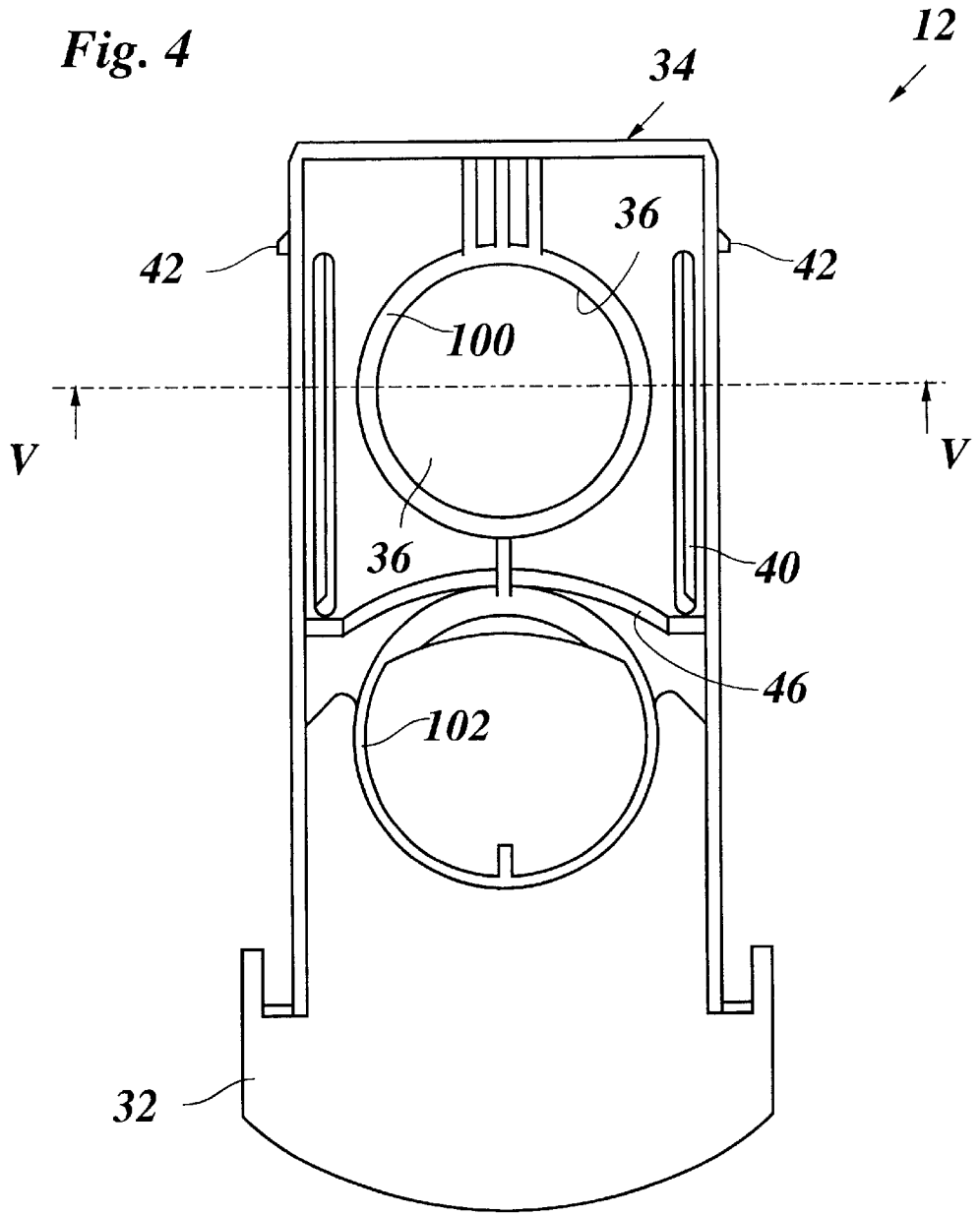
FIG. 4 is a bottom view of a drawer closing the toner reservoir.
Figure 5:
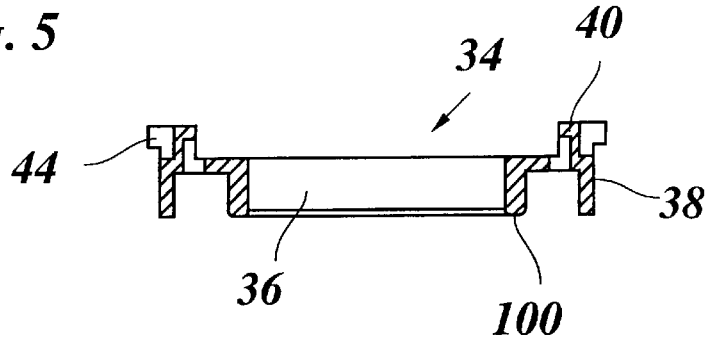
FIG. 5 is a cross-section taken along the line V—V of FIG. 4.

As can be seen in FIGS. 4 and 5, the plate 34 has raised lateral walls 38 the top edges of which form inwardly projecting guide rails 40 and outwardly projecting stops 42.

The portion of the plate 34 between the through-hole 36 and the handle 32 forms an upwardly open recess 44 (FIG. 1) which has a rounded and inclined rear wall 46 and a notch 48 extending along that wall.

Figure 6:
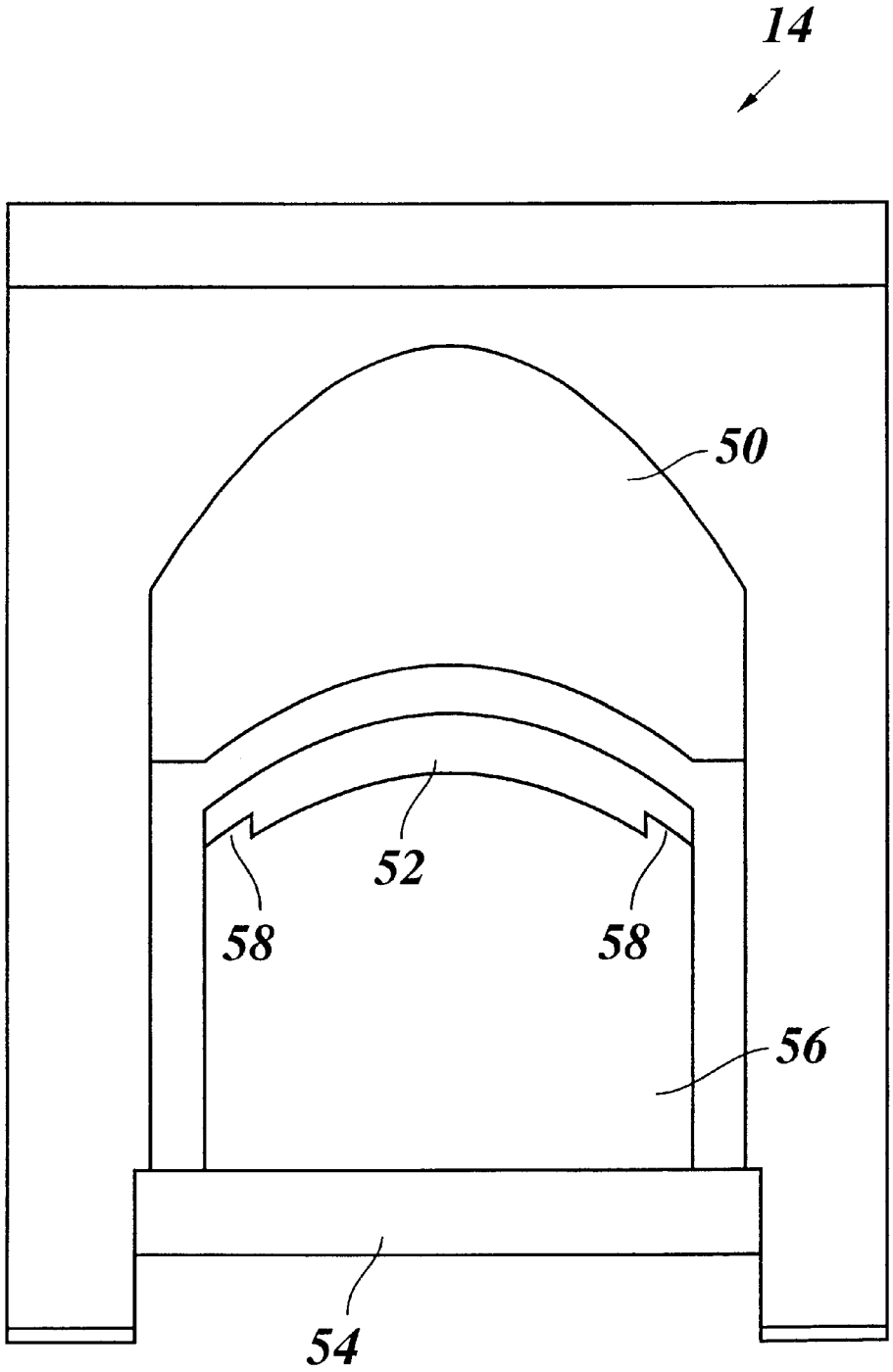
FIG. 6 is a top plan view of a mounting structure for a refill container.

The mounting structure 14 accommodates the plate 34 of the drawer 12 in the position shown in FIG. 4 and can firmly be secured to the toner reservoir 10 with fastening means which have not been shown in the drawing for simplicity. A top wall 50 of the mounting structure has a curved and inclined portion 52 which, together with a bridge 54 bridging the plate 34, defines and upwardly flaring mounting socket 56 which is open at the bottom side towards the recess 44 of the drawer 12. As is shown in FIGS. 1 and 6, the lower edge of the inclined wall portion 52 is formed with recesses 58 on either side. These recesses are engaged by the guide rails 40 of the drawer 12, so that the drawer is guided by the mounting structure 14 when it is drawn out. The outward movement of the drawer is limited by the stops 42 which cooperate with stops 60 of the mounting structure (FIG. 1).

Figure 7:
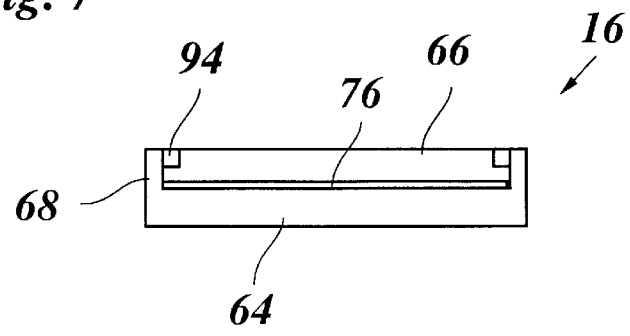
FIG. 7 is a rear view of a slide for opening and closing a spout of the refill container.
Figure 8:
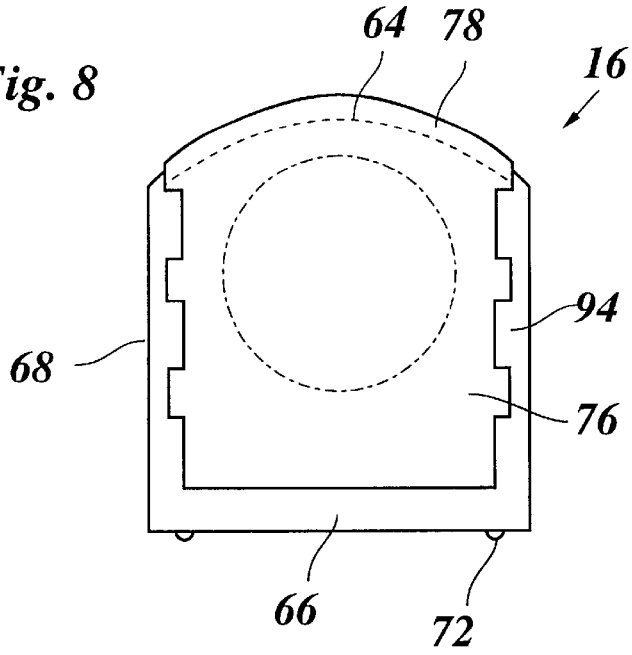
FIG. 8 is a top plan view of the slide shown in FIG. 7.

As is shown in FIGS. 1, 7 and 8, the slide 16 has a flat bottom 62 with a convexly curved rear edge 64, a front wall 66 and lateral walls 68. Adjacent to the rounded edge 64 the bottom 62 forms a cam 70 which mates with the notch 48 in the bottom of the recess 44 of the drawer 12. When the slide 16 is inserted into the recess 44, forwardly projecting abutments 72 of the slide engage the front wall 74 of the recess 44 below the bridge 54 of the mounting structure 14.

The top surface of the bottom 62 is entirely covered by a thin semi-rigid foil 76 made of a plastic material such as Melinex (polyethylene terephtalate.-film). The foil 76 has a projecting portion 78 which projects beyond the rounded edge 64. When the slide is inserted in recess 44, the projecting portion 78 of the foil overlaps the part of the plate 34 defining the rear edge of the recess 44 and rests flat on the surface of the plate 34.

Figure 9:
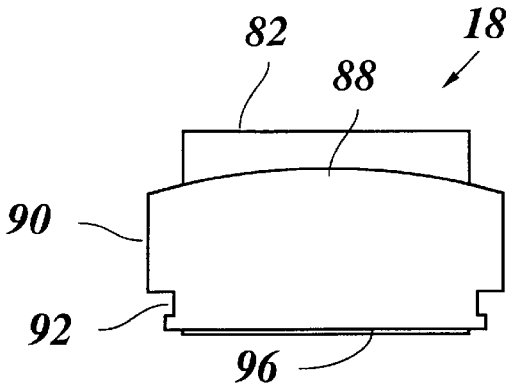
FIG. 9 is a rear view of the spout.
Figure 10:
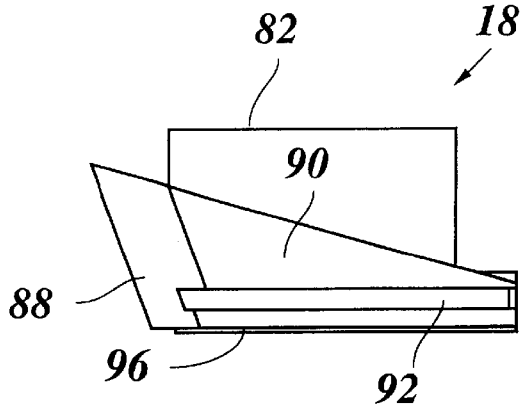
FIG. 10 is a lateral view of the spout.
Figure 11:
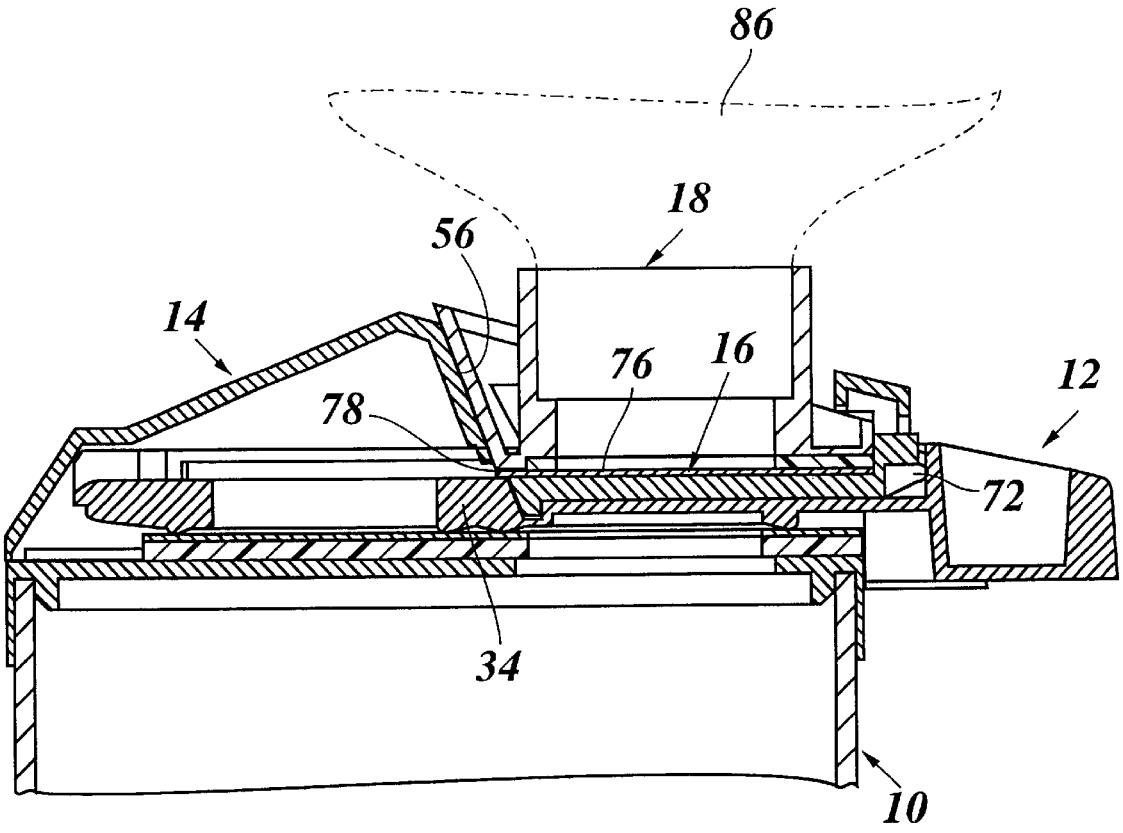
FIG. 11 is a longitudinal section of the refill mechanism in an assembled and closed state.
Figure 12:
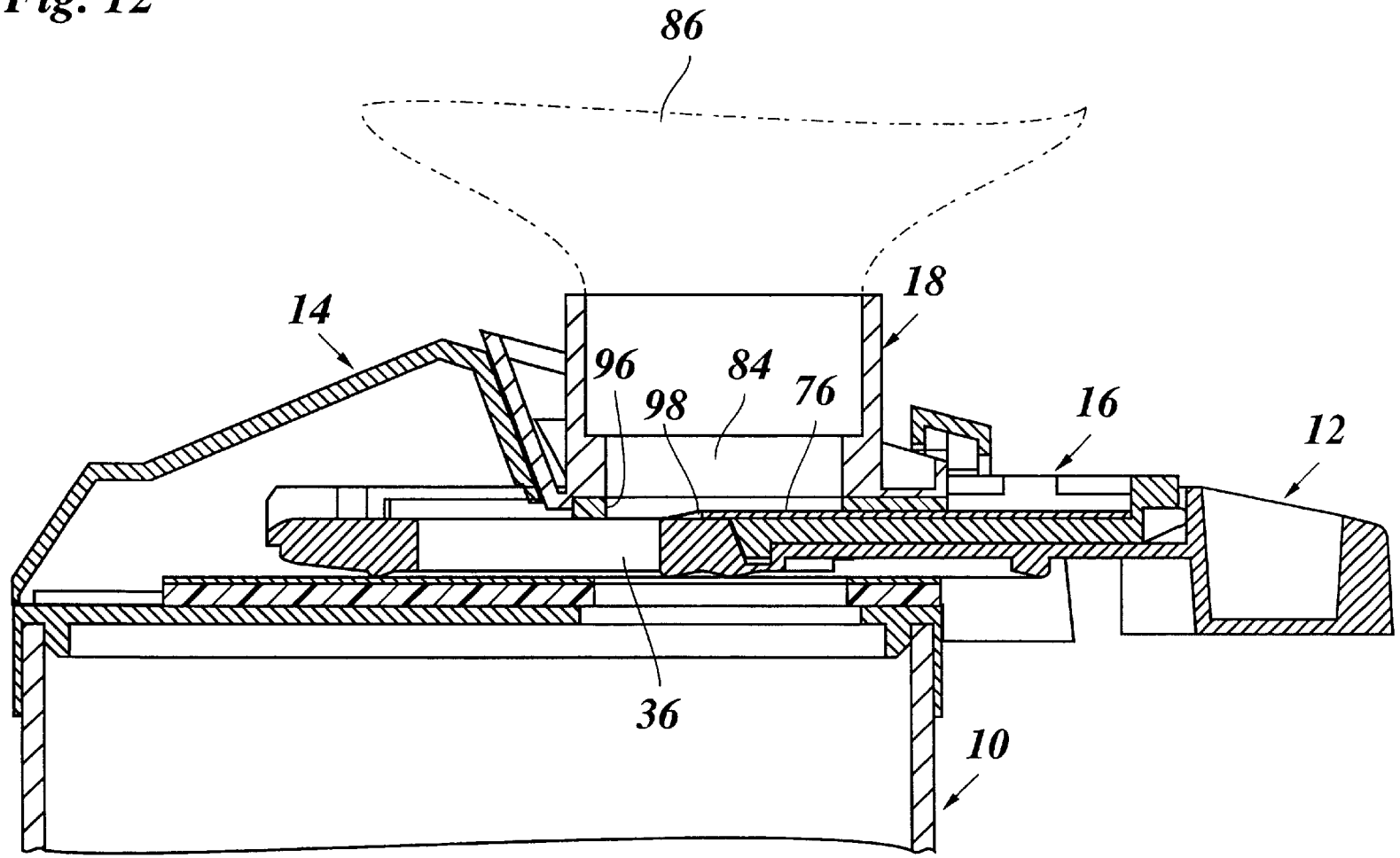
FIG. 12 is a longitudinal section of the refill mechanism in an intermediate position.

The spout 18 shown in FIGS. 1, 9 and 10 comprises a cylindrical tube 80 with a stepped bore 82 which defines a spout hole 84 and may be screwed onto or otherwise tightly secured to the neck of a bottle-shaped refill container 86 shown in phantom lines in FIGS. 11 and 12. The tube 80 is surrounded by a downwardly tapered collar 88 which mates with the mounting socket 56 formed in the mounting structure 14. As can be seen in FIGS. 9 and 10, the collar 88 has flat side walls 90 formed with grooves 92. These grooves 92 serve for guiding inwardly projecting tongues 94 provided on the side wall 68 of the slide 16. In this way, the slide 16 is slidably mounted to the lower end of the spout 18.

The bottom surface of the spout 18 is provided with an elastomeric sealing pad 96 which surrounds the spout opening 84 and resiliently engages the top surface of the foil 76, so that the spout opening 84 is tightly closed by the foil 76.

In FIG. 11, the component parts of the refill mechanism described above are shown in the assembled state. The spout 18 and the slide 16 form part of the refill container 86 as supplied by the manufacturer. The edge of the projecting portion 78 of the foil 76 is flush with the curved outer collar 88 of the spout, so that the foil is protected against defection or damage. When the toner reservoir 10 needs to be refilled, the refill container 86 is placed upside down onto the mounting structure 14, and the abutments 72 of the slide 16 are inserted underneath the bridge 54 and placed against the front wall 74 of the recess 44 in the drawer 12. The inclination of the walls 52 and 46 permits the smooth accommodation of the spout 18 and the slide 16 in the mounting socket 56 and the recess 44, respectively, by tilting the refill container 86 into the upright position. The cam 70 of the slide is thereby engaged in the notch 48 of the drawer. The projecting portion 78 of the foil 76 then rests on the top surface of the plate 34 and covers the gap formed between the rear edge 64 of the slide 16 and the wall 46 of the recess 44.

When the drawer 12 is drawn out, as is shown in FIG. 12, the slide 16 is entrained by the drawer, whereas the spout 18 is held in position by the bridge 54 of the mounting structure. The rear edge of the slide 16, which is then the trailing edge, moves across the spout opening 84. The toner powder accommodated in the refill container 86 rests on the foil 76 and is kept within the cross section of the spout opening 84, because the sealing pad 96 wipes over the surface of the foil 76. Since the projecting portion 78 of the foil covers the gap between the trailing edge of the slide 16 and the recess 44, no toner powder will enter into this gap. As is further shown in FIG. 12, the resilient sealing pad 96 slightly expands when it rides over the step 98 formed at the trailing edge of the foil 76 and then wipes over the top surface of the plate 34, so that the toner powder is wiped into the through-hole 36 of the drawer and then drops into the toner reservoir 10. The sweeping action of the sealing pad 96 at the step 98 is improved by the fact that, due to the curvature of the edge of the foil, this edge forms an acute angle with respect to the direction of movement of the pad relative to the foil.

Figure 13:
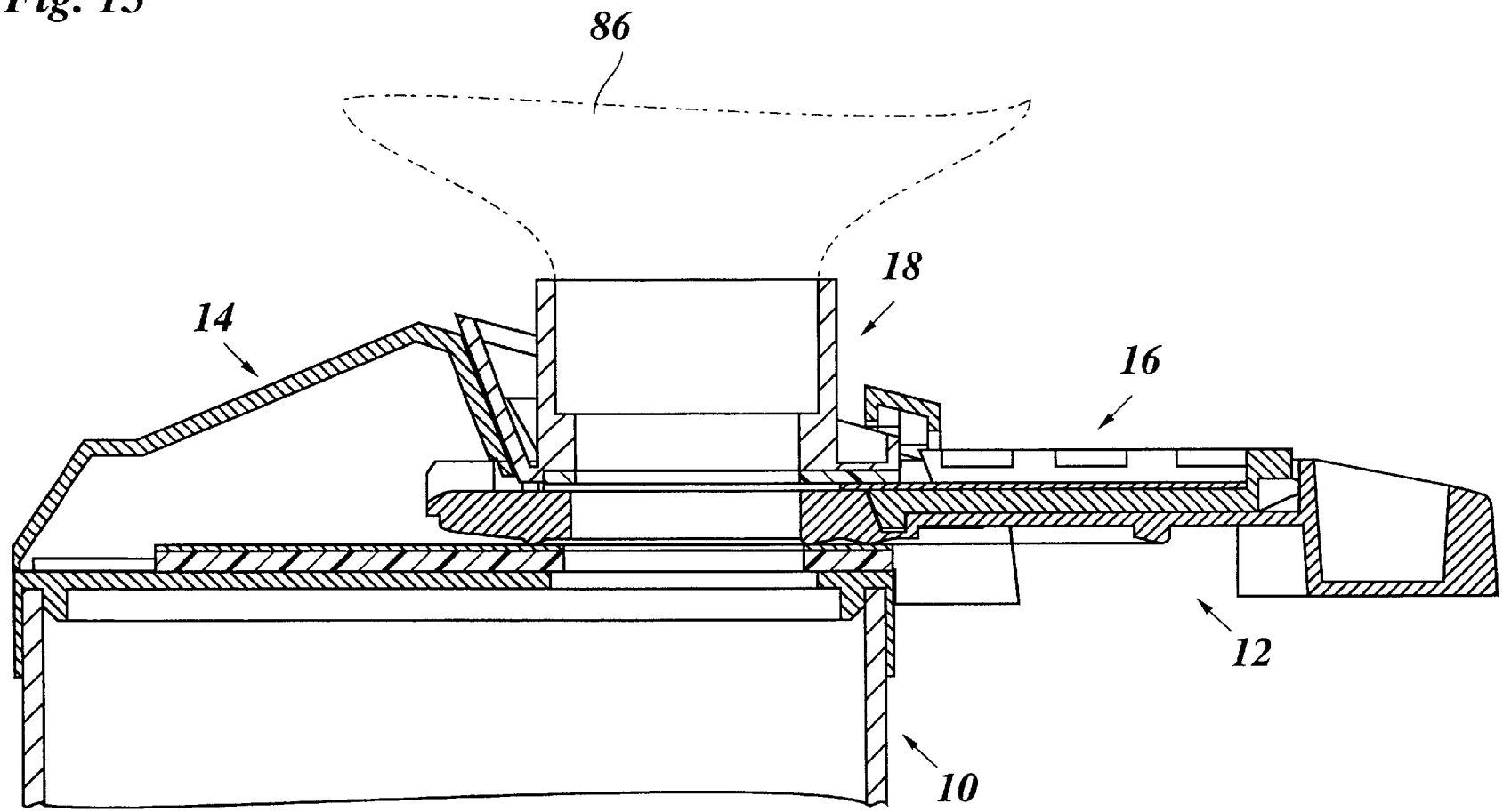
FIG. 13 is a longitudinal section of the refill mechanism in the open state.

FIG. 13 shows the refill mechanism in the fully open state, in which the through-hole 36 in the plate of the drawer 12 is fully adjusted with the spout opening 84 and the refill opening 22, so that the toner powder may drop into the toner reservoir. When the drawer 12 is then pushed back into the position shown in FIG. 11, the slide 16 comes again into engagement with the spout 18, and the projecting part 78 of the foil which then forms the leading edge scrapes over the sealing pad 96 so as to remove any toner powder adhering thereto. This toner will then be wiped into the through-hole 36 when the drawer is opened next time. Thus, the amount of toner powder accumulating behind the step 98 will always be limited, and no substantial toner will enter into the horizontal gap between the lower surface of the sealing pad 96 and the top surface of the slide 16.

It will be understood that the sealing pad 96 may have a smooth finish at the lower surface, so that no grains of elastomeric material are rubbed-off by the projecting portion 78 of the foil 76. Similarly, the film 28 on the cushion 26 supporting the plate 34 prevents disintegration of the cushion 26. Thus, it is assured that the quality of the toner in the toner reservoir will not be deteriorated by grains of elastomeric sealing material.

In order to reduce the amount of friction between the drawer 12 and the film 28 of the cushion 26 and in order to closely seal the top edge of the through-hole 30 of the cushion 26, the lower surface of the plate 34 of the drawer is formed with two annular embossments 100 and 102, as is shown in FIGS. 1 and 4. The embossment 100 surrounds the through-hole 36 in the plate 34, whereas the embossment 102 surrounds the through-hole 30 of the cushion 26 when the drawer is in the closed position. A relatively firm engagement of the resiliently supported film 28 with the embossments 100 and 102 assures that any possible toner deposited on the top surface of the foil 28 will be swept into the through-hole 30. In order to achieve this effect with high reliability, the plate 34 should be exactly flat or slightly convex, i.e., upwardly bulging, rather than concave, so that the portions of the embossments 100 and 102 which are most firmly pressed against the cushion 26 are the rear portion of the embossment 100 and the front portion of the embossment 102 as viewed in the direction in which the drawer is drawn out.

When the embossment 102 slides over the edges of the cushion 26 defining the through-hole 30, these edges may be deflected slightly downwardly because the refill opening 22 has a somewhat larger diameter. This also helps to avoid damage to the elastomeric cushion 26.

It will further be observed that the top surface of the film 28 is absolutely flat and the drawer 12 is guided only in the mounting structure 14. This has the advantage that toner powder deposited on the film 28 will not enter between the mating surfaces of the guide structures which guide the drawer 12.

The component parts of the refill mechanism, especially the drawer 12, should be made of a material which has a low adhesiveness for the toner powder. For example, POM (polyoxymethylene) is a suitable material.

The invention being thus described, it will be obvious that the same may be varied in many ways. Such variations are not to be regarded as a departure from the spirit and cope of the invention, and all such modifications as would be obvious to one skilled in the art are intended to be included within the scope of the following claims.

What is claimed is:

1. A refill mechanism for filling toner powder from a refill container into a toner reservoir of a copier or printer, which comprises:

a refill opening formed in the top of the toner reservoir;

a drawer operatively associated with the top of the toner reservoir so as to be slideable between an open position and a closed position for opening and closing the refill opening;

a spout formed on the refill container and closed by a slide; and a mounting structure for mounting the spout on the toner reservoir in a position above the refill opening, such that the slide is engaged in a recess of the drawer, so that when the drawer is moved into the open position, the slide is moved together with the drawer for opening the spout, whereby the toner powder drops into the toner reservoir, wherein the top surface of the slide is covered by a foil which projects over the trailing edge of the slide, as viewed in the direction of the opening movement, and overlaps the adjacent edge of the recess of the drawer, wherein the lower surface of the spout held in engagement with the top surface of the foil is formed by an elastic sealing pad surrounding the spout opening.

2. The refill mechanism as defined in claim 1, wherein the projecting part of the foil rests flat on the top surface of the drawer when the slide is accommodated in the recess.

3. The refill mechanism as defined in claim 2, wherein the trailing edge of the slide and the corresponding edge of the foil have a convex curvature.

4. The refill mechanism as defined in claim 1, wherein the foil is made of a semi-rigid material and the spout has an outer collar, the lower edge of which is flush with the edge of the projecting part of the foil when the drawer is in the fully closed position relative to the spout.

5. The refill mechanism as defined in claim 1, wherein the drawer is slidingly supported on a flat top surface of the toner reservoir and is slidably guided in the mounting structure.

6. The refill mechanism as defined in claim 1, wherein the drawer has a through-hole which is aligned with the refill opening when the drawer is in the open position, and the lower surface of the drawer has two circular embossments, one of which surrounds the through-hole and the other one surrounds the refill opening when the drawer is in the closed position.

7.The refill mechanism as defined in claim 1, wherein the top surface of the toner reservoir is formed by a film covering a cushion which is made of an elastomeric material and has a through-hole concentric with the refill opening.

8. The refill mechanism as defined in claim 7, wherein the diameter of the through-hole in the cushion is smaller than the diameter of the refill opening.

* * * * *